US005165569A

United States Patent [19]

Furuhashi et al.

[11] Patent Number: 5,165,569

[45] Date of Patent: Nov. 24, 1992

[54] KEG FOR DRAFT BEER

[75] Inventors: Takaaki Furuhashi; Katsuoki Kawanishi; Ryo Sakazume, all of Kawaguchi; Yutaka Fujimoto, Yamaguchi, all of Japan

[73] Assignees: Sapporo Breweries Ltd.; Fujitechno Ltd., both of Tokyo, Japan

[21] Appl. No.: 733,736

[22] Filed: Jul. 23, 1991

[30] Foreign Application Priority Data

Jul. 30, 1990 [JP] Japan ..... 2-199309
Feb. 1, 1991 [JP] Japan ..... 3-009109[U]
Feb. 1, 1991 [JP] Japan ..... 3-009110[U]

[51] Int. Cl.[5] ..... B65D 90/04

[52] U.S. Cl. ..... 220/466; 220/469; 220/420; 220/412; 220/404; 220/426

[58] Field of Search ..... 220/466, 469, 420, 4.12, 220/4.14, 426

[56] References Cited

U.S. PATENT DOCUMENTS

| | | | |
|---|---|---|---|
| 2,116,795 | 5/1938 | Lee | 220/466 X |
| 2,132,722 | 10/1938 | Coakley | 220/466 X |
| 2,151,856 | 3/1939 | Lee | 220/466 X |
| 2,214,344 | 9/1940 | Paul | 220/466 X |
| 2,249,051 | 7/1941 | Schulse | 220/466 X |
| 4,242,884 | 1/1981 | Kotschwar | 220/466 X |
| 4,997,124 | 3/1991 | Kitasatake et al. | 220/420 X |

*Primary Examiner*—Stephen Marcus
*Assistant Examiner*—Paul A. Schwarz
*Attorney, Agent, or Firm*—Kanesaka and Takeuchi

[57] ABSTRACT

A keg body for retaining draft beer substantially has adiabatic structure, in which draft beer filled in the keg body is kept cool. A part of the keg body is provided with a face which is not heat-insulated and this face is utilized as a cooling face. In case of necessity, beer is cooled from the outside through the cooling face to keep cool draft beer inside the keg body.

9 Claims, 8 Drawing Sheets

KEG FOR DRAFT BEER

BACKGROUND OF THE INVENTION

1. Field of the Invention

The present invention relates to a keg for draft beer, which is equitted with a mechanism for keeping cool.

2. Description of the Prior Art

Draft beer is generally filled in a metal container so called as a beer barrel for transportation and, at the time of sale, it is taken into a jug and the like directly from the beer barrel together with pressurized carbon dioxide. At the shipping of draft beer, draft beer is filled in a metal beer barrel at relatively low temperature. However, the temperature raises to atmospheric temperature during the transportation and storage of the draft beer. Thus, usually, the draft beer is momentarily cooled by a coil cooler at the time of sale.

There has been a problem that when the temperature of draft beer is once raised up to the atmospheric temperature, inherent taste and aroma of draft beer are lost. To use the coil cooler so as to cool beer instantly at the shop has no special problem. However, the coil cooler has, in its structure, a long pipe from the beer barrel to its outlet from which draft beer is supplied into a jug and the like. Therefore, for example, draft beer is retained in the pipe of the coil cooler during the closing time of the store, which causes pollution. The pipe is desirably washed completely at least once a day. When this washing is not done, it is not preferable for reasons of sanitation.

OBJECT AND SUMMARY OF THE INVENTION

The primary object of the invention is to provide a beer keg which can effectively keep cool draft beer retained in the keg, while shipping of draft beer to a store and storage of draft beer.

Another object of the invention is to provide a beer keg which can be forcibly cooled from outside when required.

Other objects of the present invention will be clarified by referring to the description of the specification and attached drawings.

The keg of the invention is basically used to keep cool draft beer retained inside the keg. The keg is formed of a keg body in the form of a container for retaining a liquid or draft beer therein, a cooling face formed on a part of the keg body, and an adiabatic layer for covering an outer surface of the keg body.

The liquid contained inside the key body is cooled through the cooling face, and the adiabatic layer insulates heat from outside to keep the liquid inside the key body cool. The container also includes a mouth piece for providing the liquid into the keg body and ejecting the liquid therefrom.

The cooling face may be formed on an appropriate portion, such as an upper face, a lower face or a side face. The adiabatic layer may be formed of double plates having a space therein, from which air is removed to provide vacuum condition between the two plates. The adiabatic layer may be formed by an adiabatic material laminated over the keg body.

The beer keg of the present invention has high capability of keeping beer cool due to an adiabatic structure. The adiabatic structure is not applied to the cooling face. Draft beer in the keg is kept cool by mounting an adiabatic mat, a cooling agent such as dry ice, ice, etc. or a cooling device on the cooling face. The beer keg is housed in a large refrigerator so that the draft beer in the container is cooled by touching the cooling face.

DETAILED DESCRIPTION OF THE PREFERRED EMBODIMENTS

The beer keg according to the present invention maintains draft beer at lower temperature during the time from shipping of draft beer to sale at the store, so that it can present draft beer to a customer without losing the inherent taste and aroma thereof. Moreover, the present invention does not require cooling by the conventionally used coil cooler, so that it can be treated sanitarily.

Examples of the present invention will be described below.

Figure 1:
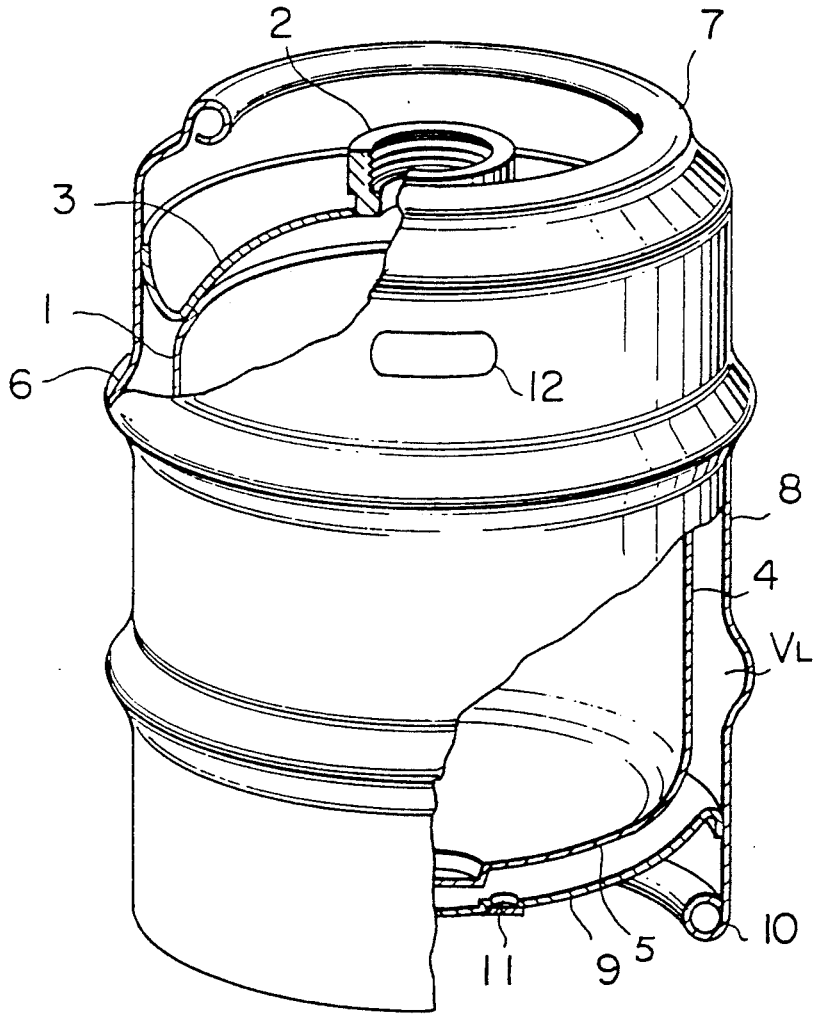
FIG. 1 is a partial cross-sectional perspective view showing a first embodiment of a beer keg of the invention.

In FIG. 1, a beer keg according to a first embodiment of the invention is shown. The beer keg comprises a combination of a keg inner cylinder 1 and a keg outer cylinder 6.

Figure 2:
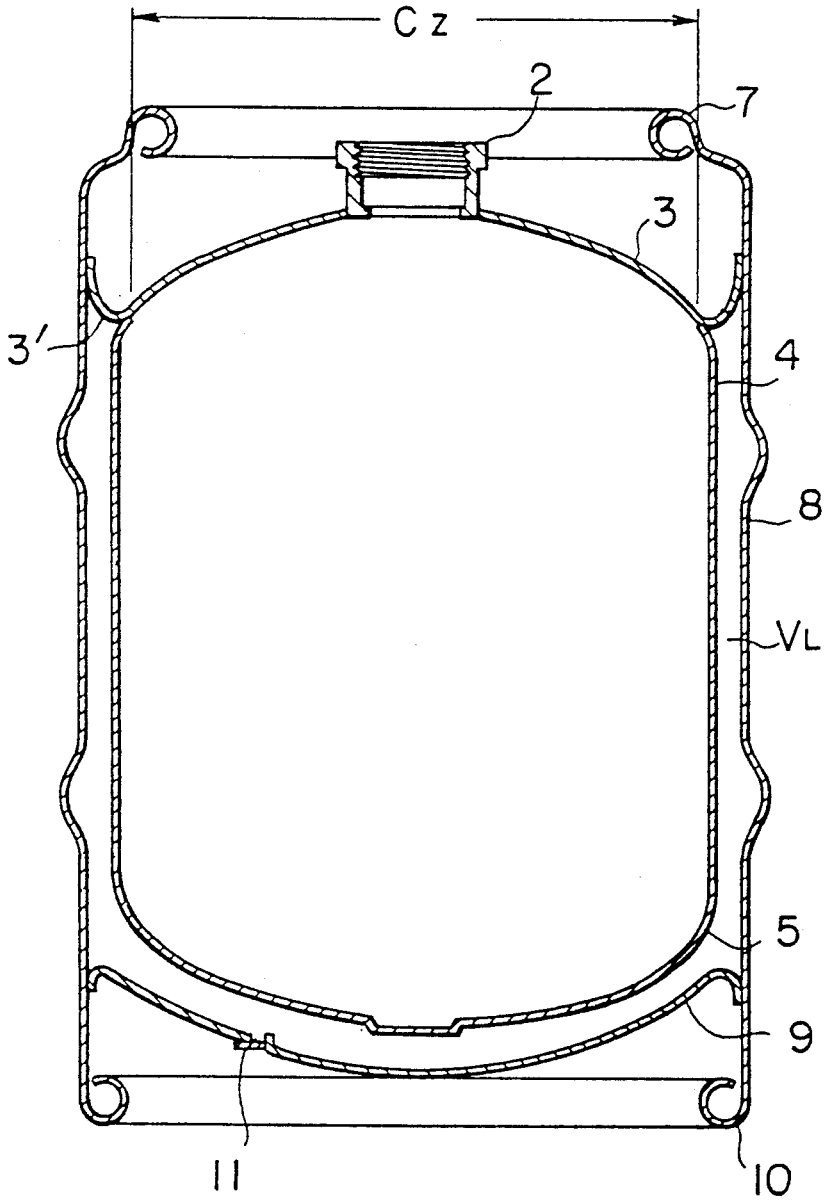
FIG. 2 is a longitudinally cross-sectional view showing a beer keg of the first embodiment.
Figure 3:
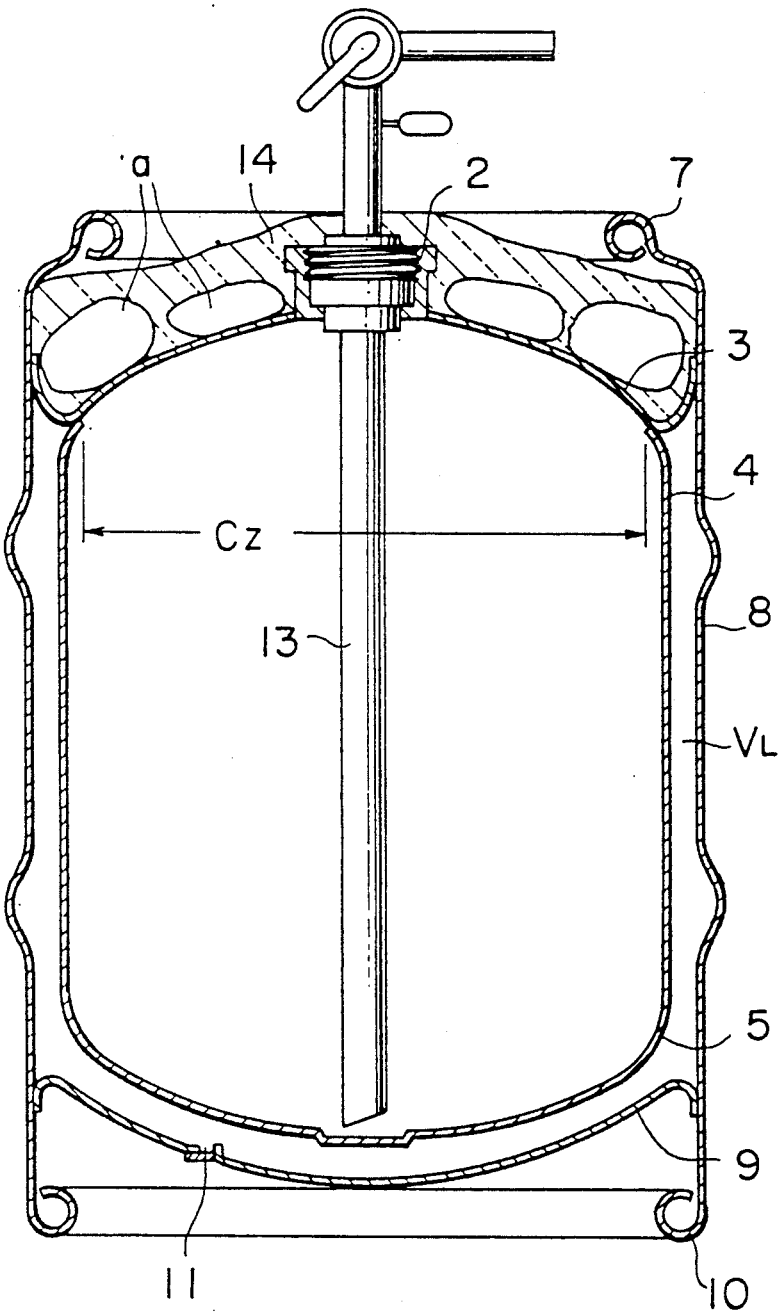
FIG. 3 is a view showing a case that draft beer in the beer keg of the first embodiment is kept cool.

As shown in FIG. 2, the keg inner cylinder 1 is a container made of thin stainless steel plate, and having a mouth piece 2 and a bottom. The keg inner cylinder 1 is prepared by welding an inner cylinder shell 4 with an inner cylinder upper plate 3 and an inner cylinder lower plate 5. The inner cylinder shell 4 is in a cylindrical form and is integrally sealed, at its upper and lower edges with the inner cylinder plate 3 and the inner cylinder plate 5, respectively, by TIG welding. In this embodiment, the mouth piece 2 is mounted on the center of the inner cylinder plate 3. A down tube 13 shown in FIG. 3 is inserted into the keg inner cylinder 1 through the mouth piece 2.

The down tube 13 is a tube for providing draft beer into the inside of the keg inner cylinder 1 and also ejecting draft beer from the cylinder 1. The down tube 13 has a carbon dioxide-valve (not shown) and a beer valve (not shown) and is screwed in the mouth piece to be fixed.

The inner cylinder upper plate 3 which covers the upper portion of the keg inner cylinder 1 is welded to the keg inner cylinder 1 in such a manner that a certain length of the keg inner cylinder 1 projects outwardly over the outer diameter of the keg inner cylinder 1.

The keg outer cylinder 6 covers the keg inner cylinder 1 and is formed of an outer cylinder shell 8 and an outer cylinder lower plate 9. The outer cylinder shell 8 has an upper grip 7 at its upper opening edge and a keg leg 10 at its lower opening edge, respectively. Both upper and lower edges are bent inwardly. The diameter of the upper edge is slightly smaller than that of the lower edge, but the upper and lower portions of the outer cylinder shell 8 may be reversible upside down. At the proper standing posture of the outer-cylinder shell 8, the upper edge acts as the upper grip 7 and the lower edge operates as the keg leg 10. At the inverted posture thereof, the upper edge acts as the keg leg 10 and the lower edge acts as the upper grip 7. If necessary, as shown in FIG. 1, a hole 12 is provided on the upper portion of the outer cylinder shell 8 so as to use it as a grip.

The above-mentioned keg inner cylinder 1 is housed in the keg outer cylinder 6 such that the projecting edge 3' of the inner cylinder upper plate 3 which covers the upper opening of the keg inner cylinder 1 is airtightly connected to the internal circumferential face of the outer cylinder shell 8 by means of TIG welding. Also, the outer cylinder lower plate 9 is airtightly welded to the inner circumferential face of the outer cylinder shell 8 by TIG welding to cover the bottom of the keg inner cylinder 1, so that the space defined between the keg inner cylinder 1 and the outer cylinder shell 8 is airtightly sealed. In the above-mentioned construction, the order of welding is important. When welding order is mistaken, the beer keg of the present invention can not be constructed. The outer cylinder lower plate 9 is provided with a nozzle 11 having a valve. After the valve is opened and the nozzle 11 is connected to a vacuum pump (not shown) air in the space defined between the barrel inner cylinder 1 and the outer cylinder shell 8 is removed. Then, the valve is closed to form vacuum adiabatic layer $V_L$ within said space. Thus, the beer keg becomes a vacuum adiabatic container except for the inner cylinder upper plate 3.

In a beer manufacturing factory, there is a line where a beer keg incorporated with the down tube 13 is automatically washed and draft beer is automatically filled in the beer keg. Similarly, the beer keg of the present invention is automatically washed and filled in with draft beer by using the above-mentioned line. The beer keg filled in with draft beer is once stored in a refrigerator for shipping to forcibly cool beer in the keg through the face Cz. In shipping, as shown in FIG. 3, the upper face of the inner cylinder upper plate 3 of the beer keg is covered with an adiabatic mat 14 to keep low temperature. The beer keg is kept in a proper standing posture, so that temperature of draft beer filled in the beer keg inner cylinder 1 does not substantially rise due to the fact that draft beer is heat-insulated by the vacuum layer between the keg inner cylinder 1 and the outer cylinder shell 8. After the beer keg of the present invention is supplied to and stored in a shop, beer is kept cool in a refrigerator in an inverted posture or horizontal posture. Draft beer is cooled through the face Cz of the inner cylinder upper plate 3, so that the draft beer can be effectively forcibly cooled.

In the beer keg of the present invention, the upper end hole of the outer-cylinder shell 8 is reduced in diameter to be smaller than the lower end hole, but either one of the upper and lower edges of the outer cylinder shell 8 becomes a grip or keg leg, so that the beer keg can be placed without distinguishing upper and lower portions. On sale of draft beer at a store, beer is supplied in a conventional manner to a jug and so on through the down tube 13 while carbon dioxide is injected with pressure, wherein the beer keg is vertically positioned to locate the mouth piece upwardly. To keep the draft beer cool during the sale is made by inserting a cooling agent a between the adiabatic mat 14 and the inner cylinder upper plate 3.

Figure 4:
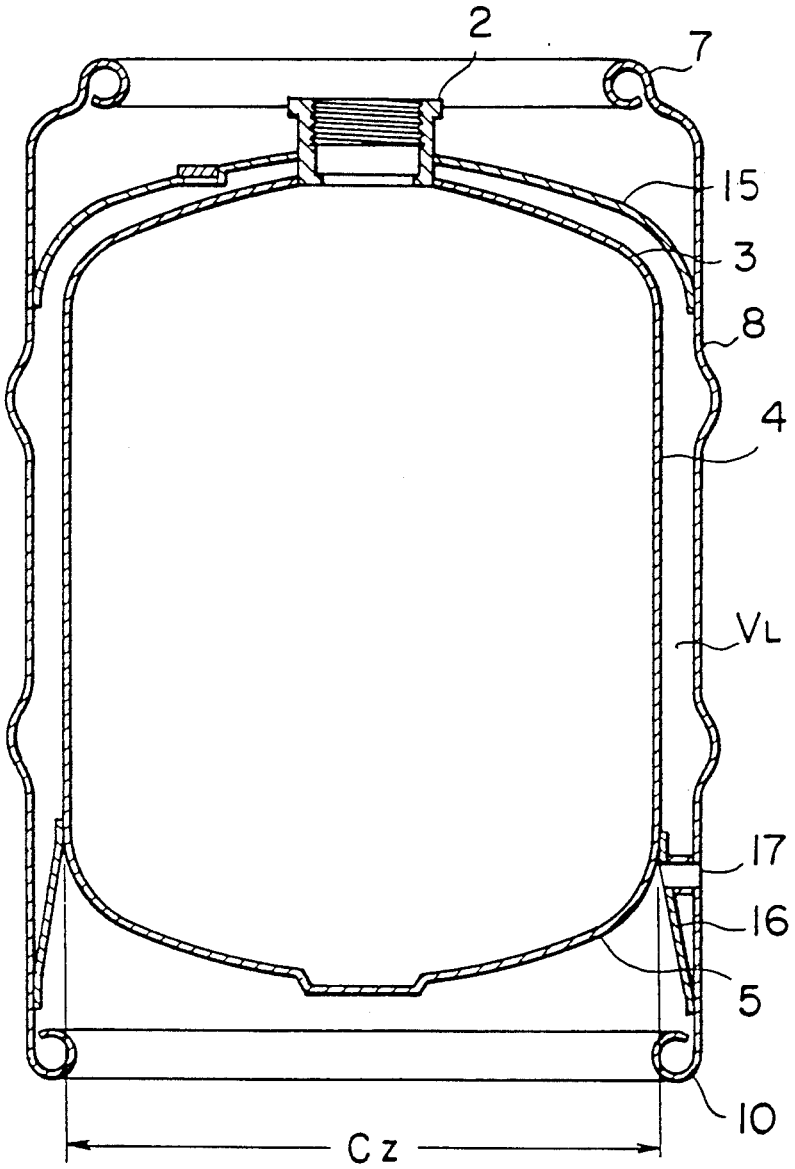
FIG. 4 is a longitudinally cross-sectional view showing a second embodiment of a beer keg of the invention.

A second embodiment is shown in FIG. 4, wherein the inner cylinder lower plate 5 at the lower face of the keg inner cylinder 1 is used as a face Cz for cooling. In this embodiment, the inner cylinder upper plate 3 is covered with an outer cylinder upper plate 15 connected to the outer cylinder shell 8 and the mouth piece 2 is fixed to the inner cylinder upper plate 3 through the outer cylinder upper plate 15. The lower edge of the keg outer cylinder 6 and the inner cylinder shell 4 are sealed by a sealing ring 16, so that a vacuum adiabatic layer $V_L$ is formed in a space surrounded by the keg outer cylinder 6.

In this embodiment, a space formed at the lower position of the inner cylinder lower plate 5 is utilized for cooling the keg. A reference numeral 17 is a water-extracting hole or an eye-hole which opens through the outer cylinder shell 8 and faces to the lower space of the inner cylinder lower plate 5. The water-extracting hole 17 is used such that when the container body is, for example, dipped in a cooling water tank to be kept cool, air in the lower space of the inner cylinder lower plate 5 is exhausted to enter cooled water into this space.

In this embodiment, when the beer keg is transported and stored, the inner cylinder lower plate 5 is inverted to orient upwardly and is forcibly cooled by a cool accumulating agent and so on as in the first embodiment. In use, the beer keg is returned to the proper standing posture and its lower portion is dipped within the cooling tank.

Figure 5:
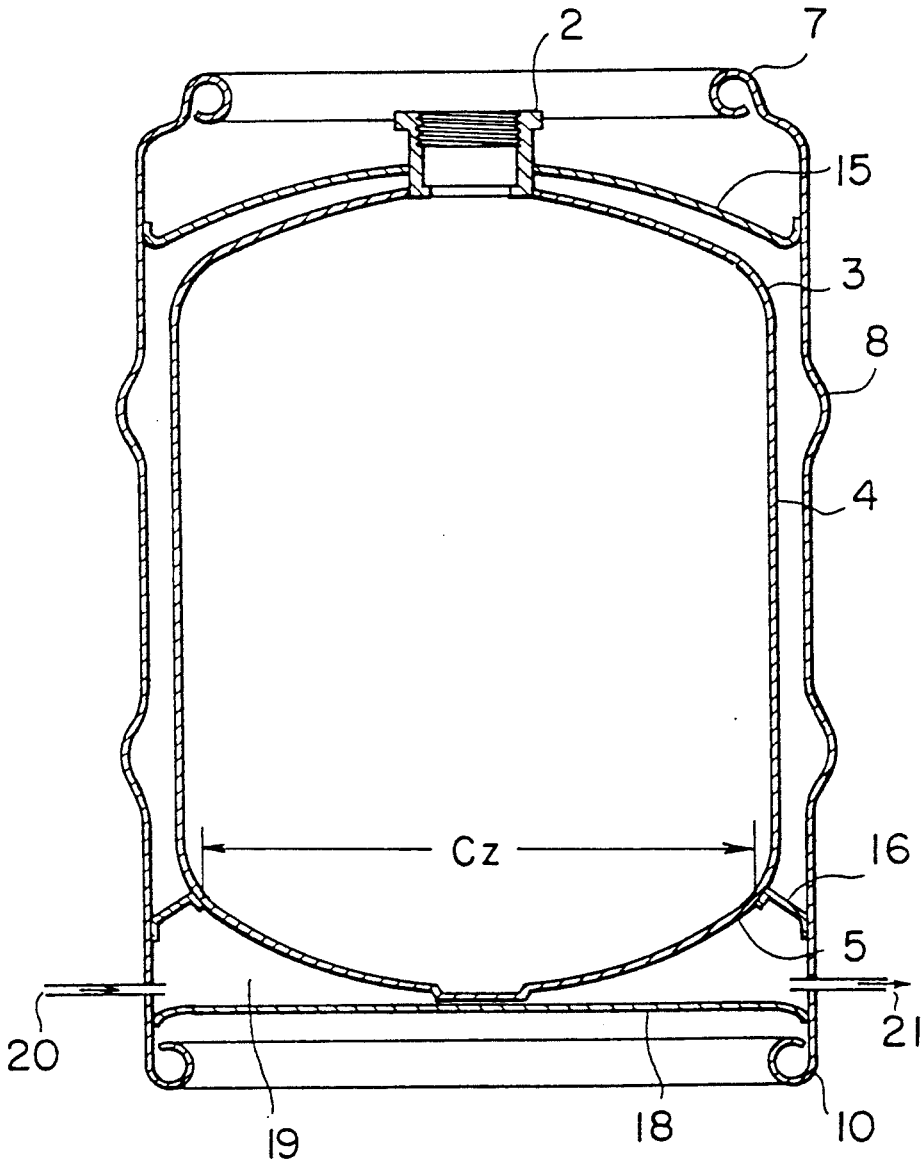
FIG. 5 is a view showing one example where draft beer in a beer keg of the second embodiment is kept cool.

FIG. 5 shows an embodiment of the beer keg in which a tank bottom plate 18 is installed on the inner circumferential face of the outer cylinder shell 8 so as to cover the inner cylinder lower plate 5 which becomes a cooling face Cz and a cooling tank 19 is pre-fabricated between the inner cylinder lower plate 5 and the keg bottom plate 18. The cooling tank 19 is provided with a water inlet pipe 20 and a water outlet pipe 21 to circulate cooled water in the cooling tank so as to allow the face Cz of the inner cylinder lower plate 5 to be forcibly cooled. According to this example, draft beer can be kept cool at suitable temperature in case of necessity. When the draft beer is kept cool by a cooled water having a temperature less than 4° C., the draft beer in the container can be kept cool as a whole by a convection phenomenon.

Figure 6:
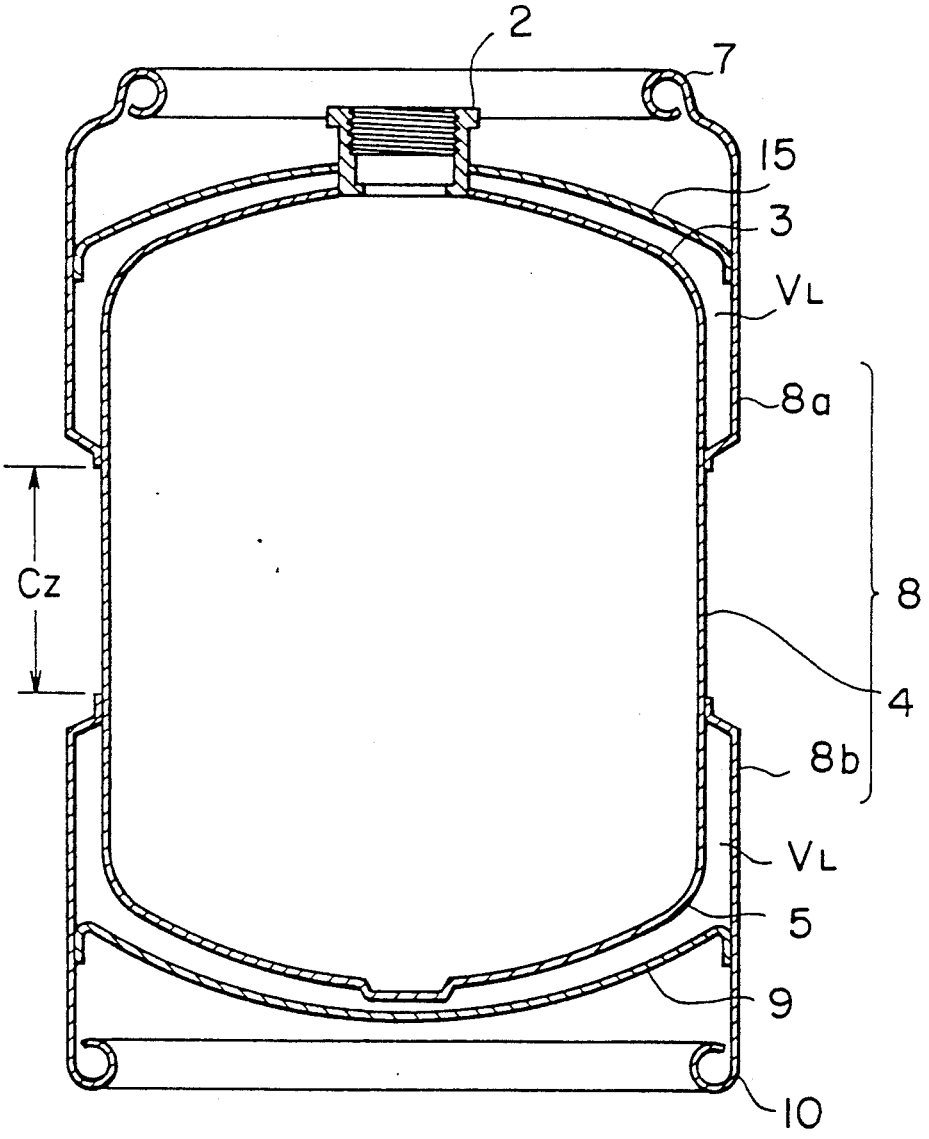
FIG. 6 is a longitudinal cross-sectional view of a beer keg of a third embodiment of the invention.

FIG. 6 shows an embodiment in which a part of the inner cylinder shell 4 is used as a cooling face Cz. In this embodiment, the inner cylinder upper plate 3 and the inner cylinder lower plate 5 are, respectively, covered by the outer cylinder upper plate 15 and the outer cylinder lower plate 9 in such a manner that the covering portions extend between an outer cylinder upper shell **8*a* and an outer cylinder lower shell 8*b* formed on the upper and lower portions of the inner cylinder shell 4 so as to differently form vacuum chamber $V_L$ between the inner cylinder shell 4 and the outer cylinder shell 8. In this structure, a part of the centeral shell portion of the inner cylinder shell 4 is exposed to the atmosphere. In this embodiment, the cooling face Cz of the inner cylinder shell 4** is forcibly cooled in the similar manner as the second embodiment to keep cool the draft beer in the keg inner cylinder.

Figure 7:
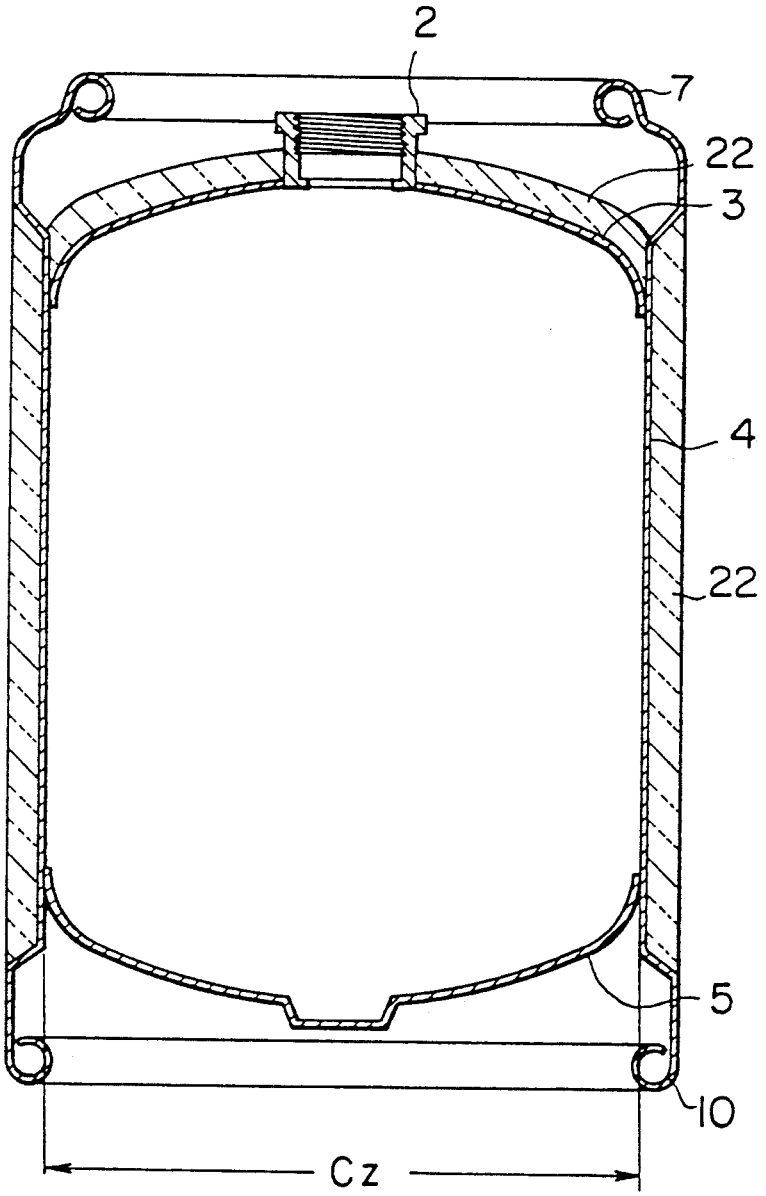
FIGS. 7 and 8 are views showing other examples of adiabatic structure of a barrel keg.
Figure 8:
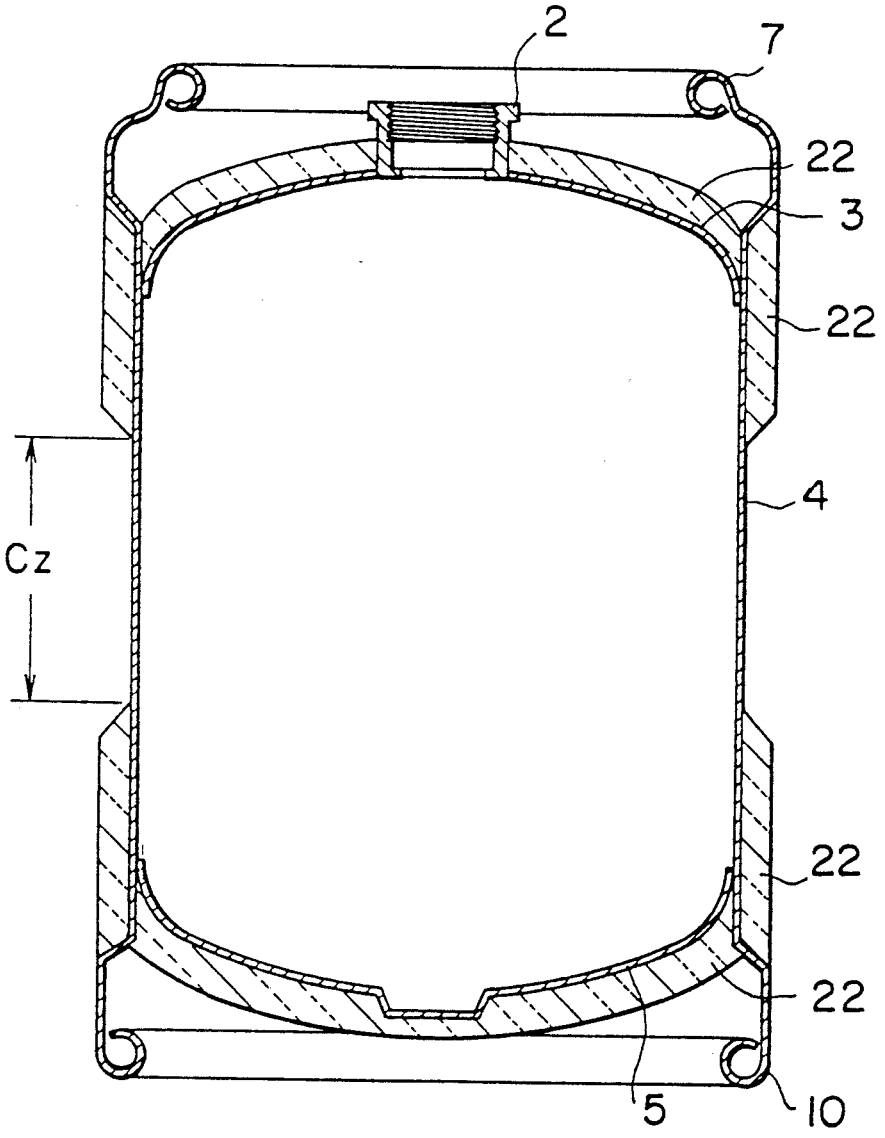

FIGS. 7 and 8 show other embodiments of adiabatic structures. In these embodiments explained before the keg body is provided with a vacuum adiabatic structure, except for a cooling face. However, it is not necessarily limited to these embodiments, but the same effect can be obtained by applying a adiabatic material to the keg body.

FIG. 7 corresponds to the embodiment of FIG. 4, in which a layer 22 made of a synthetic resin adiabatic material is applied over the whole surface of the keg body except for the inner cylinder lower plate 5. Alternatively, when the keg body inclusive of the inner cylinder lower plate 5 but except for the inner cylinder upper plate 3 is covered by a synthetic resin adiabatic material, the cooling face is formed at the side of the upper plate, which corresponds to FIG. 2.

FIG. 8 corresponds to the embodiment of FIG. 6. The keg body is covered by the layer of an adiabatic material made from synthetic resin 22 over the whole face of the inner cylinder shell 4 except for the central region.

According to the above-mentioned embodiments, the combination of the double cylinders such as inner and outer cylinders is not required and a keg body may be made by a combination of inner and outer cylinders in which the inside of the outer cylinder shell is sealed by an inner cylinder upper plate and an outer cylinder upper plate.

The adiabatic material to be used is not limited to ones described in these embodiments. By the selection of materials having high adiabatic property, the similar effects obtained by the first to third embodiments may be obtained.

What is claimed is:

1. A keg for a liquid to facilitate cooling of the liquid retained in the keg and to keep the temperature of the cooled liquid in the keg, comprising:

a keg body for retaining the liquid therein and having an upper face, a lower face, a side face and a mouth piece attached to one of the upper and lower faces, said mouth piece providing the liquid into the keg body and ejecting the liquid therefrom, said keg body being formed of a keg inner cylinder for constituting a container for the liquid and a keg outer cylinder for substantially covering the keg inner cylinder except one of the upper and lower faces of the keg body, said keg inner and outer cylinders being piled together to form a space and air being removed from the space to form vacuum adiabatic layer therebetween, and a cooling face formed on said one of the upper and lower faces of the keg body where the outer cylinder is not covered so that the liquid inside the inner cylinder is cooled through the cooling face and the temperature of the liquid inside the inner cylinder is kept by the adiabatic layer defined between the inner and outer cylinders.

2. A keg according to claim 1, further comprising a cooling device attached to the cooling face so that the liquid inside the inner cylinder is cooled by the cooling device.

3. A keg according to claim 1, wherein said mouth piece is attached to the cooling face of the keg body.

4. A keg according to claim 1, wherein said mouth piece is attached to the upper face, and the cooling face is formed at the lower face so that the liquid is cooled through the lower face of the keg inner cylinder.

5. A keg according to claim 1, wherein said keg outer cylinder has upper and lower edges having a grip and a keg leg, respectively.

6. A keg according to claim 1, wherein said cooling face is formed on the upper face of the keg body.

7. A keg according to claim 1, wherein said cooling face is formed on the lower face of the keg body.

8. A keg according to claim 1, further comprising an insulating material to be attached to the cooling face when transporing the keg so that the liquid inside the keg is kept cool.

9. A keg according to claim 8, further comprising a cooling agent situated between the cooling face the insulating material so that the liquid inside the keg is kept cool while transporting.

* * * * *